US006446585B1

(12) United States Patent
Coffey et al.

(10) Patent No.: US 6,446,585 B1
(45) Date of Patent: Sep. 10, 2002

(54) INTAKE MANIFOLD FOR COMPACT INTERNAL COMBUSTION ENGINE

(75) Inventors: Anthony L. Coffey, Grafton; Timothy S. Thiel, Plymouth, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/607,192

(22) Filed: Jun. 28, 2000

(51) Int. Cl.[7] ..... F01P 7/14

(52) U.S. Cl. ..... 123/41.1; 123/41.31; 123/184.21; 123/184.61

(58) Field of Search ..... 123/41.1, 41.31, 123/184.32, 556, 184.21–184.61

(56) References Cited

U.S. PATENT DOCUMENTS

| | | | | |
|---|---|---|---|---|
| 2,143,935 A | | 1/1939 | Chandler | |
| 2,429,105 A | | 10/1947 | Paxman | |
| 2,793,625 A | | 5/1957 | Kolbe | |
| 2,875,739 A | | 3/1959 | Marchand | |
| 2,882,884 A | | 4/1959 | Scheiterlien | |
| 2,890,690 A | | 6/1959 | Dolza | |
| 2,946,576 A | | 7/1960 | Coulter | |
| 3,709,200 A | | 1/1973 | Reisacher | 123/41.82 |
| 4,054,108 A | | 10/1977 | Gill | 123/55 |
| 4,493,294 A | | 1/1985 | Umemura | 123/41.33 |
| 4,745,885 A | | 5/1988 | Koinuma | 123/41.05 |
| 4,756,280 A | | 7/1988 | Tamba et al. | 123/41.47 |
| 4,840,152 A | | 6/1989 | Watanabe et al. | 123/52 |
| 4,934,342 A | * | 6/1990 | Tamba et al. | 123/52 MV |
| 4,953,525 A | | 9/1990 | Sakurai et al. | 123/41.28 |
| 4,972,808 A | | 11/1990 | Hasimoto | 123/41.1 |
| 5,103,774 A | | 4/1992 | Hirata et al. | 123/41.1 |
| 5,216,986 A | | 6/1993 | Ohsawa et al. | 123/52 |

* cited by examiner

*Primary Examiner*—Tony M. Argenbright
*Assistant Examiner*—Katrina B. Harris
(74) *Attorney, Agent, or Firm*—Quarles & Brady LLP

(57) ABSTRACT

An intake manifold for a compact internal combustion engine includes a pair of arm having air passageways and coolant passageways formed therethrough. The air passageways couple an air inlet at a carburetor flange to respective air outlets at the ends of the arms. The coolant passageways couple coolant inlets at the ends of arms to a coolant chamber having a first and second coolant outlet, the first coolant outlet providing a first coolant path for connecting the coolant chamber to a radiator assembly, and the second coolant outlet providing a second coolant path for connecting the coolant chamber directly to a coolant pump. A thermostatic valve disposed in the coolant chamber directs the engine coolant along the first and second coolant paths as a function of coolant temperature. The manifold further includes an integral radiator support element.

20 Claims, 2 Drawing Sheets

INTAKE MANIFOLD FOR COMPACT INTERNAL COMBUSTION ENGINE

CROSS-REFERENCES TO RELATED APPLICATIONS

STATEMENT REGARDING FEDERALLY SPONSORED RESEARCH OR DEVELOPMENT

BACKGROUND OF THE INVENTION

1. Field of the Invention

The present invention relates to the internal combustion engine, and more particularly to the intake manifold of a compact V-type internal combustion engine such as would commonly be used in a lawn mower, snow blower, generator, or the like.

2. Description of Related Art

Internal combustion engines convert chemical energy to mechanical energy for a wide variety of applications. For example, a typical combustion engine converts heat into motive power by burning a mixture of air and a flammable hydrocarbon, such as gasoline, in a plurality of cylinders each of which has a moveable piston positioned therein.

An "internal" combustion engine is so named because it describes an engine in which the fuel is burned within the engine itself. The fuel combines with oxygen in the air, and upon ignition thereof, become a gas. This gas expands to a volume that is hundreds of times as great as the liquid-form from which it came, and this volume increase occurs within a fraction of a second. The expansive force of the hot gas enables movement of the various working parts of the engine.

Most internal combustion engines are fueled using gasoline. For example, nearly all passenger automobiles and trucks are powered by gasoline engines, as are most lawn mowers, snow blowers, generators, tractors, small motorboats, motorcycles, motor-cross minibikes, all-terrain vehicles, and the like. These engines do not burn pure gasoline however, but instead burn a sprayed combination of the afore-mentioned mixture of air and gasoline.

The way in which this spray is formed varies among different types of engines. For example, raw fuel can be injected directly into the cylinders to form a ball of spray within each cylinder, or the air and fuel can be mixed within a carburetor that is upstream of the cylinders, by which the spray is then communicated to the cylinders by way of an intake manifold connected to a bank of cylinder heads. Regardless, when a spark plug within each cylinder "fires," the gasoline undergoes its phase change to actuate the piston located within the cylinder.

Not uncommonly, the plurality of cylinders are arranged into two banks that are aligned in mutually inclined positions upon a common crankcase. An engine with such an arrangement of cylinders is commonly called a "V-type" internal combustion engine because the cylinders are arranged in a V-shaped configuration. Other cylinder arrangements are, of course, also known, such as engines having cylinders connected in-line and in other opposing states.

The number of cylinders in an internal combustion engine typically varies from one to twelve, although 16-cylinder engines have also been constructed. Engines that have a high number of large cylinders are commonly used in high power applications, while other internal combustion engines are compact, having only one or two small cylinders for use in low to moderate power applications, such as would commonly be found in a lawn mower, snow blower, generator, or the like. In a compact internal combustion engine, less room is available for the numerous working parts of the engine. Thus, designers of compact engines must recognize and solve unique problems that are not encountered with large engine applications.

Engines of all types and sizes generate tremendous amounts of heat due to the combustion process. This heat is frequently dissipated through a cooling system whereby the cylinders of the engine can be air cooled or liquid cooled. In a liquid cooled engine, the cooling system may comprise a coolant manifold that directs a coolant to a radiator assembly whereby the combustion heat can be dissipated by heat exchange with atmospheric air that is circulated by a rotating cooling fan. Such a radiator is commonly attached to the engine by various mounting brackets that are situated at various locations and in various configurations around the engine.

At relatively lower coolant temperatures, it is known to temporarily divert the engine coolant away from the radiator assembly. Bypassing the radiator assembly in this fashion is traditionally accomplished by positioning a thermostat in the cylinder heads and installing a flow control device downstream of the intake manifold. While satisfactory results can be thereby obtained, the competing demands for the limited space in a compact internal combustion engine often complicate successful use of traditional bypass mechanisms.

BRIEF SUMMARY OF THE INVENTION

Briefly, the invention comprises an improved intake manifold for a compact internal combustion engine. The manifold comprises a pair of integrally formed arms that extend outward in substantially opposite directions from a centrally positioned carburetor flange. Air passageways are formed in each arm and terminate in a respective end thereof. The air passageways connect an air inlet that is formed at the carburetor flange to air outlets that are formed at the ends of the arms. In addition, a coolant chamber is integrally formed with the arms, and positioned between therebetween. Coolant passageways are formed in each arm and a coolant inlet is defined at the ends thereof. The coolant passageways connecting each coolant inlet to the coolant chamber, whereupon a first coolant path connects the coolant chamber to a radiator and a second coolant path connects the coolant chamber directly to a coolant pump. Finally, a thermostatic valve such as wax is disposed in the coolant chamber and operable to couple engine coolant received through the coolant passageways to either the first or second coolant path as a function of engine coolant temperature. Either separately or apart therefrom, the intake manifold can also comprise an integral radiator support element for attachment to a radiator assembly without the need for various mounting brackets situated throughout the engine.

As previously mentioned, small engine applications present unique challenges to the designers thereof. Particularly with respect to the compact internal combustion engine, it is desirable to get maximum usage out of a minimum number of components and in the limited space available. Accordingly, it is an object of the present invention to provide an intake manifold for a compact engine that maximizes functionality within a minimum of space. Significant cost and space savings inure to the multi-functional intake manifold, especially in this context of small engine applications. Still, it is yet another object of the present invention to provide an intake manifold that is less costly to manufacture and more functional as a whole.

The foregoing and other objects, advantages, and aspects of the present invention will become apparent from the following description. In the description, reference is made to the accompanying drawings which form a part hereof, and in which there is shown, by way of illustration, a preferred embodiment of the present invention. Such embodiment does not necessarily represent the full scope of the invention, however, and reference must also be made to the claims herein for properly interpreting the scope of this invention.

DETAILED DESCRIPTION OF THE INVENTION

Figure 1:
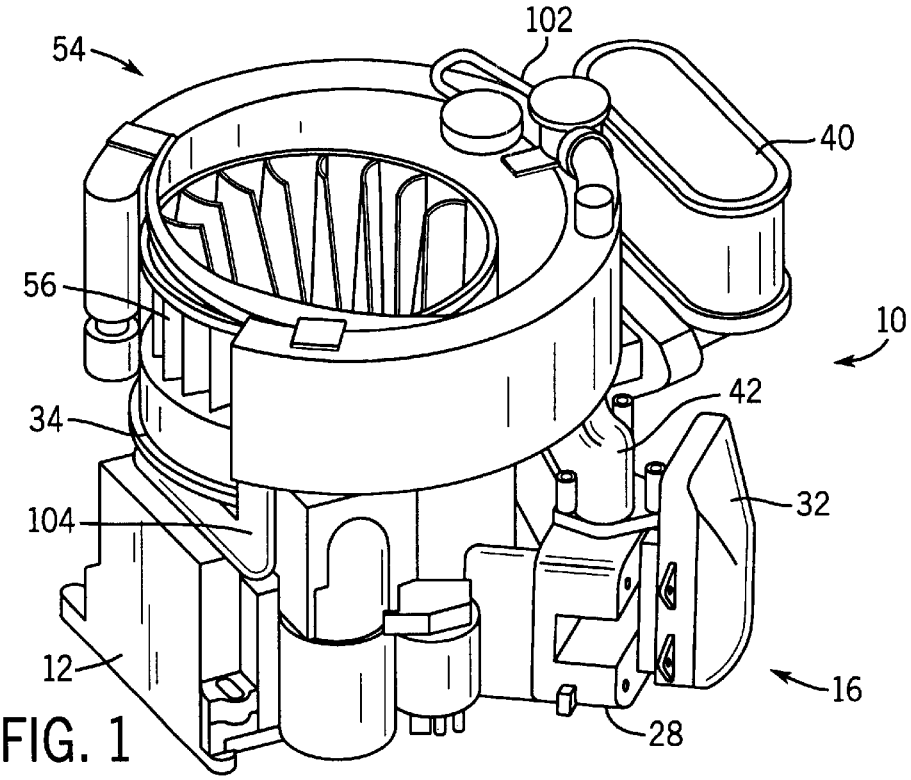
FIG. 1 is a perspective view of a vertical shaft V-type internal combustion engine incorporating the present invention.
Figure 2:
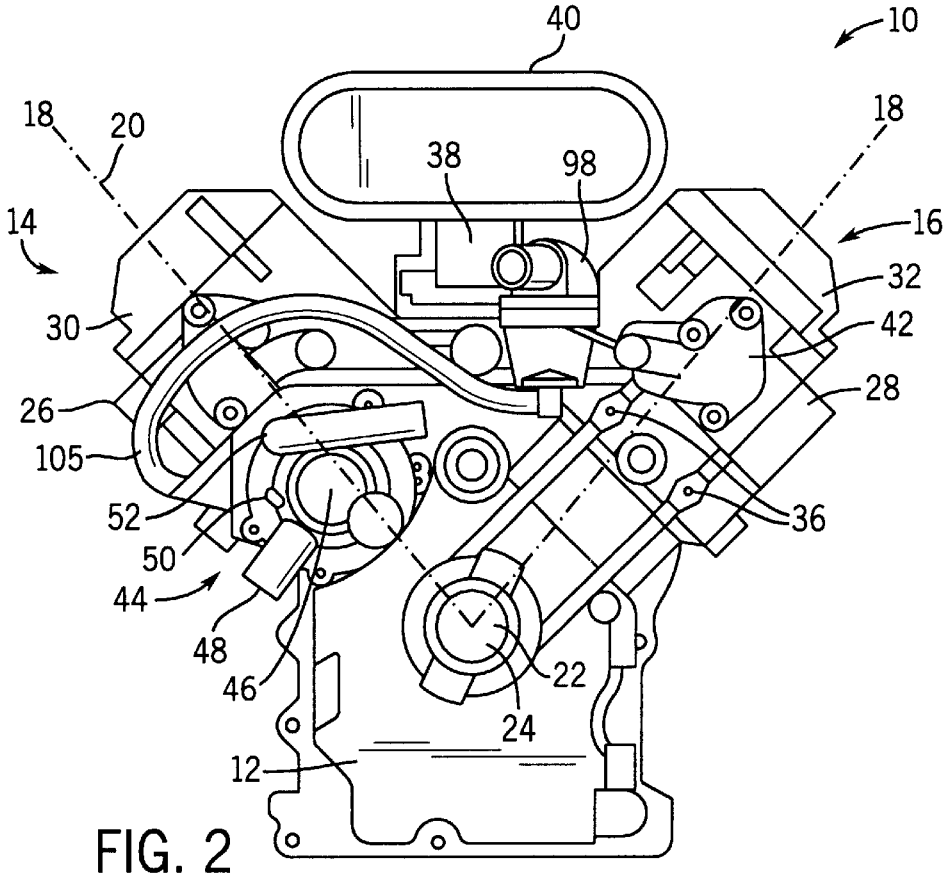
FIG. 2 is a top plan view of the engine of FIG. 1 shown with the radiator assembly and flywheel removed.

Referring now to the drawings and particularly to FIGS. 1–2, a compact horizontal shaft V-type internal combustion engine 10 includes a crankcase 12 that functions as the primary frame structure for the engine 10. The crankcase 12 is preferably cast aluminum and has two cylinders 14,16 formed therein. The cylinders 14,16 are preferably arranged such that one cylinder 14 is vertically offset from the other cylinder 16 to form a V-shaped configuration 18 as shown by the dashed lines 20. Each cylinder 14,16 receives a reciprocating piston (not shown) for rotatably driving a crankshaft 22 that has a first end 24 extending through the crankcase 12 at the center of the V-junction 18. A cylinder head 26,28 encloses each respective piston by way of an attached valve cover 30,32.

The first end 24 of the crankshaft 22 supports a flywheel 34, which is generally disposed above the crankcase 12 and supported by a plurality of ignition module posts 36. A second end (not shown) of the crankshaft 22 connects to an oil pan (not shown) mounted to the bottom of the crankcase 12 for rotatably driving an apparatus such as a lawn mower, snow blower, generator, or the like. A timing gear (not shown) engages the crankshaft 22 for rotatably driving a camshaft (not shown). The rotatably mounted camshaft is disposed in the V-space 18 and controls various valves that allow the air and fuel mixture to enter and exit the cylinders 14,16 during operation of the engine 10.

The air for combustion is drawn into a carburetor 38 from an air filtration system comprising an air filter 40. More specifically, the air is drawn into a barrel (not shown) of the carburetor 38 due to a vacuum effect created as the piston in each cylinder 14,16 moves down. Without providing the air filter 40 prior to the carburetor 38, dirt or dust or other contaminants can be drawn into the cylinders 14,16 as part of that air and fuel mixture that is generated by the carburetor 38, thus ultimately becoming part of the oil film that lubricates the moving parts of the engine 10, causing significant damage. Regardless, the air and fuel are mixed within the carburetor 38, which is located upstream of the cylinders 14,16, after which the spray is communicated to the cylinder heads 26,28 by way of an intake manifold 42 connected thereto. The intake manifold 42 will be discussed in greater detail below.

The heat that is generated about the moving pistons within the cylinders 14,16 is dissipated through a cooling system 44 that comprises a coolant pump 46 preferably having an inlet port 48, a bypass inlet port 50, and a common exit port 52. The cooling system 44 also includes a radiator assembly 54 by which the combustion heat is dissipated by a heat exchange with atmospheric air that is circulated by a rotating cooling fan 56. An engine coolant, such as a mixture of water and ethylene glycol or the like, is preferably circulated through the cooling system 44, including the radiator assembly 54. More specifically, a rotatably driven impeller shaft (not shown) within the coolant pump 46 extends through an aperture into a working chamber filled with the coolant fluid, whereby rotation of the impeller shaft causes impeller blades (not shown) within the chamber to compress the coolant and force it out the exit port 52 for simultaneous delivery to the cylinder heads 26,28 by coolant hoses (not shown) that are preferably formed from a material known in the art for its ability to handle coolant under pressure, such as steel, rubber, or the like. The coolant can also be delivered to each of the cylinder heads 26,28 sequentially without departing from the scope of this invention. Regardless, the coolant flows from the cylinder heads 26,28 to coolant jackets (not shown) that surround and thereby cool the cylinders 14,16. From the water jackets surrounding the cylinders 14,16, the coolant is directed to the intake manifold 42 whereby it will be directed to either the radiator assembly 54 if it is sufficiently warm or directly back to the coolant pump 46 if it is not, as will be elaborated upon below.

Figure 3:
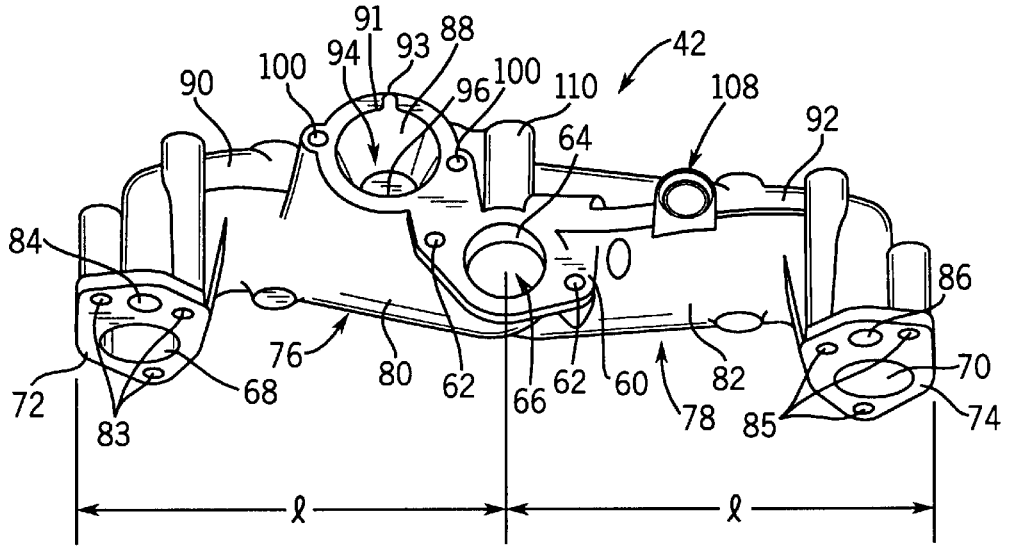
FIG. 3 is a perspective view of the intake manifold of FIG. 1.
Figure 4:
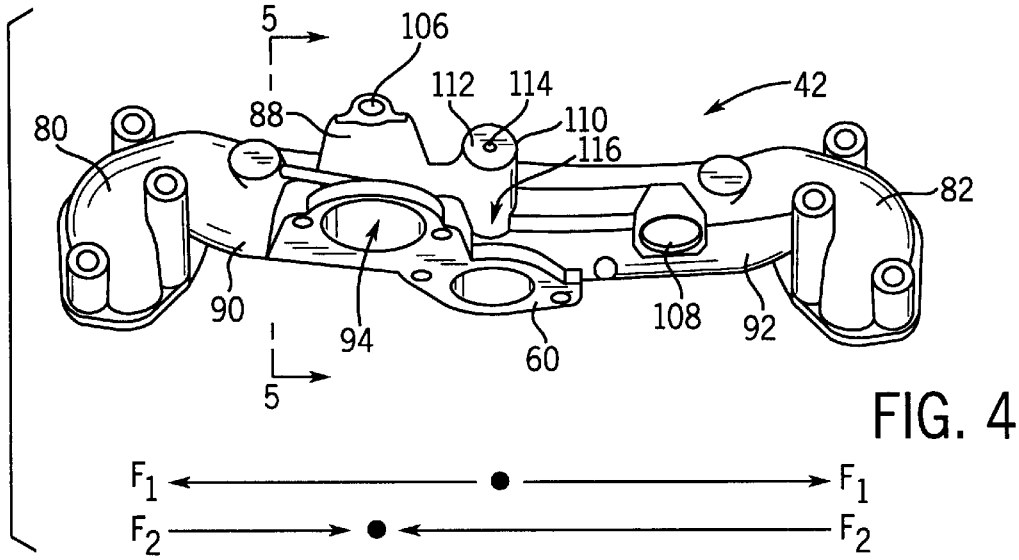
FIG. 4 is an alternative perspective view of the intake manifold of FIG. 3.
Figure 5:
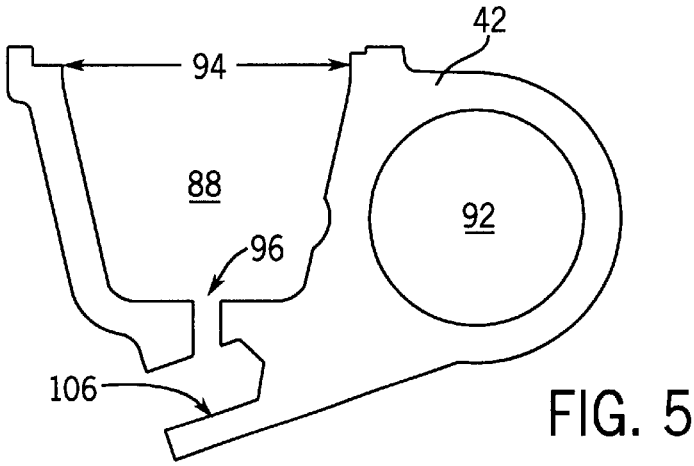
FIG. 5 is a cross-sectional view taken along line 5—5 of FIG. 4.

Referring primarily to FIGS. 3–4, the intake manifold 42, which is now shown removed from the engine 10, comprises a carburetor flange 60 that is shaped and formed for connection to the carburetor 38 by known fastener techniques such as providing a plurality of threaded apertures 62 to receive fastener mechanisms such as bolts (not shown). More specifically, the apertures 62 are disposed about an orifice defined by an interior surface 64 of the carburetor flange 60, the interior surface 64 defining an air inlet 66 that extends through the flange 60.

The mixture of air and fuel from the carburetor 38 is delivered to and through the air inlet 66, which is in communication with air outlets 68,70 that are in a respective end 72,74 of a pair of arms 76,78. The arms 76,78 branch radially outward from the carburetor flange 60 in preferably and substantially opposite directions. Each individual arm 76,78 has an enclosed air passageway 80,82 extending therethrough for communicating the air and fuel mixture from the air inlet 66 to the air outlets 68,70, the interior of the intake manifold 42 being shaped to form a substantially configured T-junction from the air inlet 66 to the arms 76,78. The respective ends 72,74 of the arms 76,78 are preferably formed for sealing engagement to the respective cylinder heads 26,28 by known fastener techniques, such as providing a plurality of threaded apertures 83,85 about each respective end 72,74 in order to receive fastener mechanisms such as bolts (not shown). In addition, sealing means between the cylinder heads 26,28 and ends 72,74 of the arms 76,78 are also preferred, and each arm 76,78 is generally of substantially the same length l as measured from a central point of the air inlet 66. Finally, the ends 72,74 of the respective arms 76,78 are preferably disposed such that they face internally to the V-space 18 of the engine 10.

Furthermore, each end 72,74 is additionally formed with a respective coolant inlet 84,86 extending therethrough. The plurality of coolant inlets 84,86 are in communication with a centrally disposed coolant chamber 88 that is an integral part of the manifold 42. These coolant inlets 84,86 communicate with the coolant chamber 88 through enclosed coolant passageways 90,92 that extend through each arm 76,78. During operation of the engine 10, liquid engine coolant flows from the cylinder heads 26,28 to the coolant inlets 84,86 for delivery to the integral coolant chamber 88. In a preferred embodiment, the coolant chamber 88 is positioned substantially proximal to the carburetor flange 60 and substantially intermediate the arms 76,78. Also in a preferred embodiment, the perimeter 91 of a surface defining the exterior of the coolant chamber 88 can be formed with a thermostat vent 93. While a traditional thermostat vent 93 is provided as a part of a thermostat itself, the present invention provides the thermostat vent 93 as an integrated part of the intake manifold 42.

The coolant chamber 88 is characterized by a first coolant outlet 94 and a second coolant 96 outlet whereby the engine coolant can be directed through a respective first coolant path or second coolant path as a function of engine temperature. More specifically, the coolant chamber 88 is formed to receive a thermostat housing 98 (see FIG. 2) that attaches thereto by fastener techniques such as providing a plurality of threaded apertures 100 that receive fastener mechanisms such as bolts (not shown). In addition, sealing means between the outer perimeter 91 of the first coolant outlet 94 and the thermostat housing 98 are preferred. The thermostat housing 98 is provided in order to receive therein a thermostat that directs the coolant through the appropriate coolant outlet 94,96 as a function of engine coolant temperature. For instance, a thermostat comprising a temperature wax can be used whereby increasing temperatures of the wax cause it to expand and effectively plug the second coolant outlet 96 by actuating a piston (not shown) that controls the valve, so that a majority of the liquid coolant is passed through the first coolant outlet 94 instead of through the second coolant outlet 96. Even at relatively low engine coolant temperatures, it is not preferred to entirely close off the second coolant outlet 96, as it is instead preferred to permit a trace amount of the coolant to flow therethrough at all times of engine 10 operation. Furthermore, the thermostat housing 98 is preferably disposed towards the middle of the intake manifold 42 in order to allow a balanced flow when in bypass operation, i.e. during engine warm up, as will be elaborated upon below.

Because drops in engine coolant temperature tend to be greatest nearest the thermostat, placing the thermostat in the traditional location, i.e. the cylinder heads 26,28, tends to create flow imbalances throughout the cooling system 44. In recognition of this problem, the present invention forms the coolant chamber 88 that receives thermostat housing 98 as an integrated element of the intake manifold 42. Thus, by preferably positioning the flow control device near the middle of the intake manifold 42, the pressure drop from each cylinder 14,16 is balanced, causing a substantially equal distribution of coolant throughout the cooling system 44. By using substantially equal lengths l and diameters of components, the pressure drop for the two fluid paths to the cylinders 14,16 is thereby balanced, yielding equivalent fluid flow paths whereby each cylinder 14,16 receives equal and adequate amounts of coolant so as to avoid coolant and engine 10 temperature variations. Thus, by integrating the coolant chamber 88 that receives the thermostat and thermostat housing 98 within the intake manifold 42, a desirable integral bypass is thereby provided.

The first coolant path connects the coolant chamber 88 to the radiator assembly 54. More specifically, the coolant flows from the thermostat housing 98 to the radiator assembly 54 whereby the combustion heat is dissipated by a heat exchange with atmospheric air that is circulated by the rotating cooling fan 56. Transportation of the engine coolant from the thermostat housing 98 to the radiator assembly 54 is accomplished by a plurality of coolant hoses 102 (see FIG. 1) as described above. Thereafter, the coolant travels through the radiator assembly 54 by known techniques, and exits therefrom by another plurality of coolant hoses 104 en route to the coolant pump 46 by way of the inlet port 48 for additional circulation through the cooling system 44.

If, on the other hand, the engine coolant is not of a sufficient temperature to require substantial cooling, flow through the radiator assembly 54 can be bypassed due to the second coolant outlet 96 that is formed as an integral part of the coolant chamber 88. More specifically, the second coolant path connects the coolant chamber 88 directly to the coolant pump 46, thereby forming an integrated bypass control means within the casting of the intake manifold 42. In operation, this secondary coolant outlet 96 is connected directly to the coolant pump 46 by a coolant bypass hose 105 that is connected to the bypass inlet port 50 of the coolant pump 46. When the engine coolant follows this path through the cooling system 44, its flow through the radiator assembly 54 is effectively bypassed. This functionality is achieved by forming the bypass means as a direct component of the intake manifold 42, for which the bypass coolant hose 105 attaches directly to the intake manifold 42 by a standard technique such as providing a threaded fitting 106 integral thereto.

Therefore, the engine coolant flows through the engine 10 by substantially following one of two paths, the first of which will be described in reference to a hot engine condition and the second of which will be described in reference to a cold engine condition, the path being determined in accordance with the operation of the thermostatic valve. For example, if the engine coolant is of a sufficient temperature to require flow through the radiator assembly 54, it follows a lengthened sequential path through the following components of the engine 10: coolant pump exit port 52; coolant hose (not shown); cylinders 14,16; respective coolant inlets 84,86 of the intake manifold 42; respective coolant passageways 90,92; coolant chamber 88; first coolant outlet 94; thermostat housing 98; coolant hose 102; radiator assembly 54; coolant hose 104; inlet port 48; coolant pump 46; and then ultimately back through the coolant pump exit port 52. If, on the other hand, the engine coolant is not of a sufficient temperature to require flow through the radiator assembly 54, it follows a shortened sequential path through the following components of the engine 10: coolant pump exit port 52; coolant hose (not shown); cylinders 14,16; respective coolant inlets 84,86 of the intake manifold 42; respective coolant passageways 90,92; coolant chamber 88; second coolant outlet 96; coolant bypass hose 105; bypass inlet port 50; coolant pump 46; and then ultimately back through the coolant pump exit port 52. Thus, the intake manifold 42 directs the engine coolant either to the radiator assembly 54 or directly back to the coolant pump 46 in accordance with the operating temperature of the engine coolant, as monitored and controlled by the thermostatic valve positioned within the thermostat housing 98 that attaches to the intake manifold 42.

In an exemplary embodiment, the bypass is preferably in operation when the engine coolant is in a temperature range between ambient temperature and approximately 170° Fahrenheit. Below ambient temperature, only a small amount of engine coolant flows through the first coolant outlet 94, the majority of the coolant being directed instead through the secondary coolant outlet 96. Then, as the temperature of the engine coolant progressively increases, the thermostat valve progressively opens wider whereupon increasing amounts of the coolant are caused to circulate through the radiator assembly 54 before being returned to the coolant pump 46 for recirculation. Finally, above 170° F., only the aforementioned small amount of engine coolant flows through the secondary coolant outlet 96, the majority of the coolant being directed instead through the first coolant outlet 94 and radiator assembly 54.

In the event the engine coolant should become superheated such that passage through the radiator assembly 54 could be ineffectual or damage inducing, an opening 108 (see FIGS. 3–4) for a temperature switch can be provided on the intake manifold 42. As known by those of ordinary skill in the art, temperature switches allow a fail-safe coolant path in the event the engine coolant exceeds the temperature threshold of the temperature switch. Accordingly, the integrated intake manifold 42 of the present invention provides an opening 108 for accommodating such a relief valve temperature switch.

As will also be appreciated by those skilled in the art, the intake manifold 42 of the present invention is formed such that the air passageways 80,82 and coolant passageways 90,92 are preferably formed in counter-flowing heat exchange relation with one another when the air and fuel mixture passes through the air passageways 80,82 and the engine coolant passes through the coolant passageways 90,92. In FIG. 4, these counter-flowing heat exchange relations are depicted by arrows $F_1$ that show the direction of the combustion air and fuel mixture through the air passageways 80,82, and by arrows $F_2$ that show the direction of the engine coolant flow through the coolant passageways 90,92. These counter-flowing paths maximize the heat transfer exchanges therebetween, whereupon the combustion air can be warmed prior to its discharge into the cylinders 14,16, and the heated coolant can be initially cooled prior to its delivery to the radiator assembly 54.

Either separately or apart from the embodiment described above, the intake manifold 42 may also comprise an integral radiator support element 110 for attachment to the radiator assembly 54. More specifically, the radiator support element 110 is integrally formed with the intake manifold 42 and extends outward therefrom to a mounting end 112, the distal mount end 112 preferably being formed for attachment to the radiator assembly 54 by a longitudinal bore 114 that is drilled and tapped therein to receive a radiator mounting fastener such as a stud or the like for securing the radiator assembly 54 to the engine 10. In addition, the radiator support element 110 is preferably an elongated post-like member that is wider at a base 116 that is attached to the intake manifold 42, the tapering nature of the support element 110 thereby imparting strength and vibrational resistance to the support element 110. Moreover, the support element 110 is preferably formed from the same die cast aluminum as the intake manifold 42. By thus forming the radiator support element 110 as an integral part of the air intake manifold 42, the number of engine 10 parts required is thereby reduced as mounting brackets and the like are no longer required for supporting and holding the radiator assembly 54 in place within the engine 10.

The spirit of the present invention is not intended to be limited to any embodiment described above. Rather, the details and features of an exemplary embodiment were disclosed as required. Without departing from the scope of this invention, other modifications will therefore be apparent to those skilled in the art. Thus, it must be understood that the detailed description of the invention and drawings were intended as illustrative only, and not by way of limitation.

To apprise the public of the scope of this invention, the following claims are made:

What is claimed is:

1. An intake manifold for a compact internal combustion engine comprising:

a pair of integrally formed arms extending outward in substantially opposite directions from a centrally positioned carburetor flange and terminating in respective ends;

an air passageway formed in the arms and defining an air inlet in the carburetor flange, the air passageway connecting the carburetor flange to the end of each arm to define respective air outlets thereat;

a coolant chamber integrally formed with the arms and positioned between the ends of the arms;

a coolant passageway formed in the arms and defining respective coolant inlets at the ends of the arms, the coolant passageway connecting each coolant inlet to the coolant chamber;

a first coolant path for connecting the coolant chamber to a radiator;

a second coolant path for connecting the coolant chamber to a coolant pump; and a thermostatic valve disposed in the coolant chamber and operable to couple engine coolant received through the coolant passageway to the first and second coolant paths as a function of engine coolant temperature.

2. The intake manifold of claim 1 whereby the air passageway and the coolant passageway are in counter-flowing heat exchange relation with one another when an air and fuel mixture is directed through the air passageway and the engine coolant is directed through the coolant passageway.

3. The intake manifold of claim I wherein the coolant chamber is formed to receive a housing for the thermostatic valve.

4. The intake manifold of claim 1 wherein each arm is of substantially the same length.

5. The intake manifold of claim 1 wherein the coolant chamber is substantially intermediate the arms.

6. The intake manifold of claim 1 wherein the coolant chamber is substantially proximal to the carburetor flange.

7. The intake manifold of claim 1 wherein the coolant chamber is formed with an integral thermostat vent.

8. The intake manifold of claim 1 wherein the end of each arm is formed for sealing engagement to a cylinder head of a cylinder bank.

9. The intake manifold of claim 1 further comprising an opening for a temperature switch.

10. The intake manifold of claim 1 wherein the manifold is formed from a casting process.

11. The intake manifold of claim 1 further comprising:

a radiator support element integrally formed with the arms and extending outwardly therefrom to a mounting end; and a mount formed at the mounting end for attachment to a radiator assembly.

12. The intake manifold of claim 11 wherein the radiator support element is an elongated post-shaped member.

13. The intake manifold of claim 12 wherein the elongated post-shaped member is wider at a base attached to the arms.

14. The intake manifold of claim 11 wherein the mount comprises a longitudinal bore sized to receive a radiator mounting fastener.

15. An intake manifold for a compact internal combustion engine comprising:

a pair of integrally formed arms extending outward in substantially opposite directions from a centrally positioned carburetor flange and terminating in respective ends;

an air passageway formed in the arms and defining an air inlet in the carburetor flange, the air passageway connecting the carburetor flange to the end of each arm to define respective air outlets thereat;

a coolant passageway formed in the arms and defining respective coolant inlets at the ends of the arms, the coolant passageway connecting each coolant inlet to a coolant outlet; and a post-shaped radiator support element having a widened base integrally formed with the arms and extending outwardly therefrom to a mounting end; and a mount opening formed at the mounting end for mounting a radiator assembly.

16. The intake manifold of claim 15 whereby the air passageway and the coolant passageway are in counter-flowing heat exchange relation with one another when an air and fuel mixture is directed through the air passageway and an engine coolant is directed through the coolant passageway.

17. The intake manifold of claim 15 wherein each arm is of substantially the same length.

18. The intake manifold of claim 15 wherein the end of each arm is formed for sealing engagement to a cylinder head of a cylinder bank.

19. The intake manifold of claim 15 further comprising an opening for a temperature switch.

20. The intake manifold of claim 15 wherein the manifold is formed from a casting process.

* * * * *

UNITED STATES PATENT AND TRADEMARK OFFICE

CERTIFICATE OF CORRECTION

PATENT NO. : 6,446,585 B1 
DATED : September 10, 2002
INVENTOR(S) : Anthony L. Coffey et al.

It is certified that error appears in the above-identified patent and that said Letters Patent is hereby corrected as shown below:

Column 8,
Line 39, change "claim I" to -- claim 1 --.

Signed and Sealed this

Fourth Day of March, 2003

JAMES E. ROGAN
*Director of the United States Patent and Trademark Office*